US009111482B2

(12) United States Patent
Yamamoto

(10) Patent No.: US 9,111,482 B2
(45) Date of Patent: Aug. 18, 2015

(54) DISPLAY DEVICE AND METHOD FOR CONTROLLING AND UPDATING DISPLAY ON A DISPLAY DEVICE WITH TWO DISPLAY SECTIONS

(71) Applicant: SEIKO EPSON CORPORATION, Tokyo (JP)

(72) Inventor: Takekuni Yamamoto, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 224 days.

(21) Appl. No.: 13/678,379

(22) Filed: Nov. 15, 2012

(65) Prior Publication Data

US 2013/0135276 A1 May 30, 2013

(30) Foreign Application Priority Data

Nov. 24, 2011 (JP) ..... 2011-256269

(51) Int. Cl.
*G09G 5/00* (2006.01)
*G09G 3/20* (2006.01)
*G09G 3/34* (2006.01)

(52) U.S. Cl.
CPC ..... *G09G 3/20* (2013.01); *G09G 3/344* (2013.01); *G09G 2310/0221* (2013.01); *G09G 2330/021* (2013.01)

(58) Field of Classification Search
CPC ..... G02F 1/167
USPC ..... 345/1.1, 107
See application file for complete search history.

(56) References Cited

U.S. PATENT DOCUMENTS 5,663,748 A * 9/1997 Huffman et al. ..... 345/173
5,696,982 A * 12/1997 Tanigawa et al. ..... 715/236
6,512,497 B1 * 1/2003 Kondo et al. ..... 345/1.1
7,636,071 B2 * 12/2009 O'Gorman ..... 345/1.1
8,669,955 B2 * 3/2014 Nishio et al. ..... 345/173

FOREIGN PATENT DOCUMENTS

JP 2000-284883 A 10/2000

* cited by examiner

*Primary Examiner* — Roy Rabindranath
(74) *Attorney, Agent, or Firm* — Maschoff Brennan

(57) ABSTRACT

A display device is equipped with a control device that controls operation of a first and a second display section, and a memory device that stores image data of an image to be displayed on the first and the second display section as image data of one combined image. The control device includes a rewriting device that rewrites the images on the first and the second display section by dividing and supplying the image data of one combined image respectively to the first and the second display section, and a power supply stopping device that stops supply of a power supply potential, upon judging that one of the images on the first and the second display section is not to be rewritten, to the one of the first and the second display section.

4 Claims, 6 Drawing Sheets

DISPLAY DEVICE AND METHOD FOR CONTROLLING AND UPDATING DISPLAY ON A DISPLAY DEVICE WITH TWO DISPLAY SECTIONS

BACKGROUND

1. Technical Field

The present invention relates to the technical field of display devices, such as, for example, electrophoretic display devices, and methods for controlling the display device.

2. Related Art

As an electrophoretic display device, a display device that displays, for example, image data of an electronic book, etc. on two screens is known. Such devices are generally driven with a comparatively small battery to improve the portability, and the power consumption during display operation is required to be reduced to lengthen the operation time. In this connection, for example, JP-A-2000-284883 (Patent Document 1) proposes a technology in which driving of a non-selected screen among the two screens is stopped, or the lighting (that is, the backlight) of the non-selected screen is turned off.

However, according to the technology described in Patent Document 1, images to be displayed on the two screens are managed by two independent memories, such that the processing with the software becomes complex. Moreover, selection and non-selection of the two screens are controlled individually to control the individual power supply, such that the power supply control becomes inefficient, and the amount of power consumption grows accordingly. The technology described in Patent Document 1 entails a technical problem in that, even if the power consumption can be reduced, other problems still exist unsolved.

SUMMARY

In accordance with some aspects of the invention, a display device that is capable of suitably reducing the power consumption and a method for controlling the display device are provided.

In accordance with an aspect of the invention, a display device includes: a first display section and a second display section for displaying images; a control device that controls operation of the first display section and the second display section; and a memory device that stores image data of an image to be displayed on the first display section and image data of an image to be displayed on the second display section as image data of one combined image. According to an aspect of the invention, the control device includes a rewriting device that rewrites the images on the first display section and the second display section by dividing and supplying the image data of one combined image respectively to the first display section and the second display section, a judging device that judges as to which one of the images on the first display section and the second display section is to be rewritten, and a power supply stopping device that stops supply of a power supply potential, upon judging that one of the images on the first display section and the second display section is not to be rewritten, to the one of the first display section and the second display section.

The display device in accordance with an aspect of the invention is equipped with the first display section and the second display section where images of an electronic book, a music score, etc., for example, are displayed. The first display section and the second display section may each be formed from, for example, an electrophoretic display device that includes micro capsules containing electrophoretic elements, or a liquid crystal display device having substrates and liquid crystal retained between the substrates. Note that the first display section and the second display section in accordance with an aspect of the invention are configured such that their power supply control can be mutually independently performed.

The operation of the first display section and the second display section is controlled by the control device that is composed, for example, as a controller. For example, the first display section and the second display section may each be configured with a plurality of pixels arranged in, for example, a matrix corresponding to intersections of a plurality of scanning lines and a plurality of data lines. The control device supplies data potentials corresponding to image data to the pixel electrodes of the respective pixels in the first display section and the second display section. More concretely, the control device supplies data potential corresponding to image data to the pixel electrode in each of the plural pixels during a predetermined frame period. More specifically, the control device selects each of the plural scanning lines once in a predetermined order during a predetermined frame period, and supplies data potentials to the pixel electrodes at the pixels corresponding to the selected scanning line through a plurality of data lines. The control device performs such data potential supply (in other words, a write operation to write data potentials according to the image data to the pixel electrodes of the plural pixels during a predetermined frame period) multiple times, whereby an image according to the image data is displayed on the first display section and the second display section.

The display device in accordance with an aspect of the invention may further include a storage device that stores image data of an image to be displayed in the first display section and image data of an image to be displayed in the second display section, respectively. The storage device is configured, for example, as a buffer memory, and temporarily stores image data of two images to be displayed in the first display section and the second display section as image data of one combined image. In other words, the image data of the images that are to be displayed respectively in the first display section and the second display section are not separately stored in two mutually different storage devices but is stored collectively in one storage device. As a result, the processing, from the viewpoint of the software that operates the device, can be simplified.

When the display device in accordance with an aspect of the invention operates, the combined image stored in the storage device may be divided and supplied to the first display section and the second display section, respectively, by the rewriting device in the control device. As a result, the images in the first display section and the second display section are rewritten.

At the time of the image rewriting described above, which of the images on the first display section and the second display section is rewritten may be judged by the judging device. The judgment device makes a judgment as to the display sections where the image is to be rewritten based on the image data of the combined image stored in the storage device (that is, the image data of images that are to be displayed in the first display section and the second display section). For example, when the combined image is an image extending across both the first display section and the second display section, the judging device judges that both of the images on the first display section and the second display section are to be rewritten. On the other hand, when the combined image is an image that is displayed only on the first display section or the second display section, the judging device judges that only one of the images on the first display section and the second display section is to be rewritten.

In accordance with an aspect of the invention, when it is judged that one of the images on the first display section and the second display section is not to be rewritten, the power supply stopping device may stop the supply of the power supply potential to the one of the first display section and the second display section wherein the image is judged not to be rewritten. In this manner, the power consumption can be eliminated on the one of the first display section and the second display section wherein the image is not required to be rewritten, so that the power consumption can be effectively reduced.

After stopping the supply of the power supply potential, if the judgment device judges that the image of the display section where the supply of the power supply potential was stopped should be rewritten, the power supply stopping device may control to restart the supply of the power supply potential.

According to the display device in accordance with some aspects of the invention, as described above, the power consumption can be suitably reduced.

In the display device in accordance with an aspect of the invention, the judgment device described above may have coordinate information corresponding to the first display section and the second display section, and may judge as to which one of the images of the first display section and the second display section is to be rewritten based on coordinates where the combined image should be displayed.

According to this aspect, the coordinate information corresponding to the first display section and the second display section is stored in the judgment device. Note that the "coordinate information" may be, for example, parameters that indicate detailed image display positions (for example, the display position in the unit of each pixel) in each of the first display section and the second display section, and may be set according to the size of each of the first display section and the second display section or the like at the time of design.

In accordance with an aspect of the invention, the judgment device uses the coordinate information described above, to judge as to which one of the images of the first display section and the second display section is to be rewritten. Concretely, when the coordinates that should display the combined image are coordinates extending across both the first display section and the second display section, the judgment device judges that both of the images of the first display section and the second display section are to be rewritten. On the other hand, when the coordinates that should display the combined image are coordinates corresponding only to one of the first display section and the second display section, the judgment device judges that only one of the images of the first display section and the second display section is to be rewritten.

In this manner, by making a judgment using the coordinate information, the display section where the image is to be rewritten can be more easily and adequately judged. Therefore, the power supply control can be more suitably carried out.

In accordance with another aspect of the invention, the first display section and the second display section may have memory property.

According to this aspect, the first display section and the second display section are configured as a device having the memory property, such as, for example, an electrophoretic display device, a cholesteric liquid crystal display device, and an electronic powder type display device. Even after the supply of the power supply potential is stopped, the display section that has the memory property can keep displaying an image that has been displayed so far. Therefore, in the present embodiment, the image keeps being displayed in the display section where the supply of the power supply potential was stopped by the power supply stopping device. Therefore, the power consumption can be suitably reduced without ruining the image display performance.

In accordance with another embodiment of the invention, a method for controlling a display device is provided. The display device includes a first display section and a second display section for displaying images; a control device that controls operation of the first display section and the second display section; and a memory device that stores image data of an image to be displayed on the first display section and image data of an image to be displayed on the second display section as image data of one combined image. The control method includes rewriting the images on the first display section and the second display section by dividing and supplying the image data of one combined image respectively to the first display section and the second display section, judging as to which one of the images on the first display section and the second display section is to be rewritten, and stopping supply of a power supply potential, upon judging that one of the images on the first display section and the second display section is not to be rewritten, to the one of the first display section and the second display section.

In accordance with the method for controlling a display device in accordance with an aspect of the invention, similar to the display device of the embodiment described above, the supply of the power supply potential to one of the first display section and the second display section wherein the image is not rewritten is stopped. As a result, the power consumption can be effectively reduced.

In accordance with the method for controlling a display device in accordance with other aspects of the invention, it is possible to implement various embodiments similar to those of the display device in accordance with the embodiment described above.

Operation and other advantages of the invention will become more apparent from embodiments for carrying out the invention described below.

DESCRIPTION OF EXEMPLARY EMBODIMENTS

Preferred embodiments of the invention will be described with reference to the accompanying drawings.

Device Configuration

The overall configuration of a display device in accordance with an embodiment of the invention will be described with reference to FIG. 1.

Figure 1:
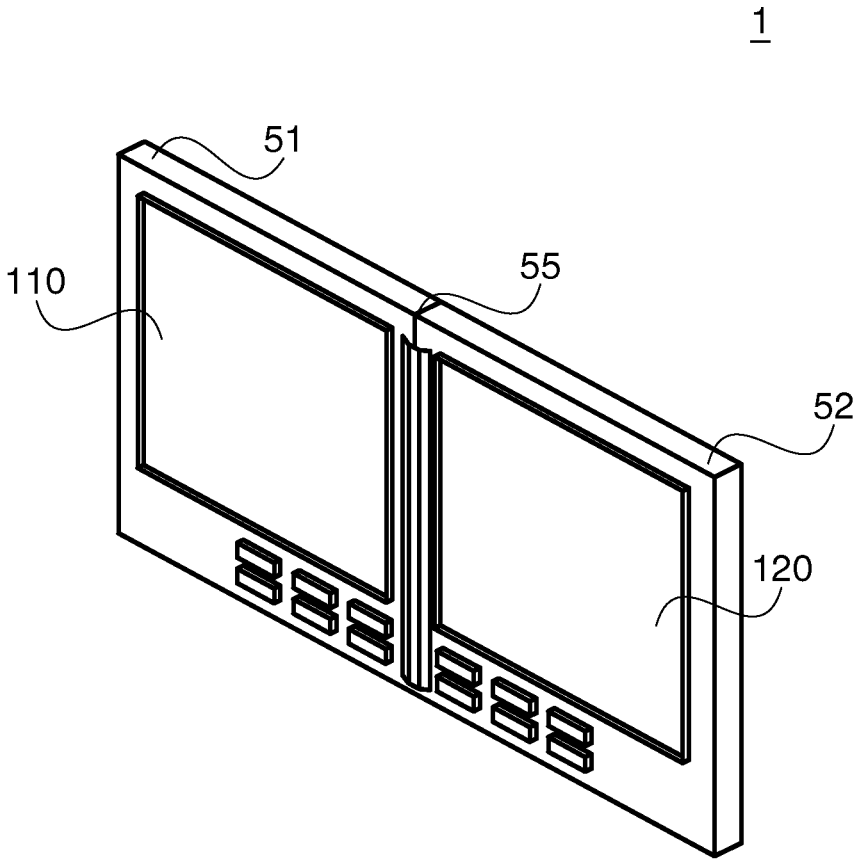
FIG. 1 is a perspective view showing the overall configuration of a display device in accordance with an embodiment of the invention.

As shown in FIG. 1, the display device 1 in accordance with the present embodiment is configured mainly with a front cover portion 51, a rear cover portion 52, and a hinge portion 55 that joins the front cover portion 51 and the rear cover portion 52.

The front cover portion 51 has a left screen 110. The rear cover portion 52 has a right screen 120. The left screen 110 and the right screen 120 are composed as electrophoretic display devices that control electrophoretic elements, respectively, and display images. The left screen 110 and the right screen 120 are one example of the "first display section" and the "second display section" of the embodiment of the invention, respectively.

Next, a concrete configuration of a display section of the display device in accordance with the present embodiment will be described with reference to FIG. 2 to FIG. 4. Because the left screen 110 and the right screen 120 mentioned above have mutually similar configurations, only the configuration of the left screen 110 will be described below, and the description about the configuration of the right screen will be omitted.

Figure 2:
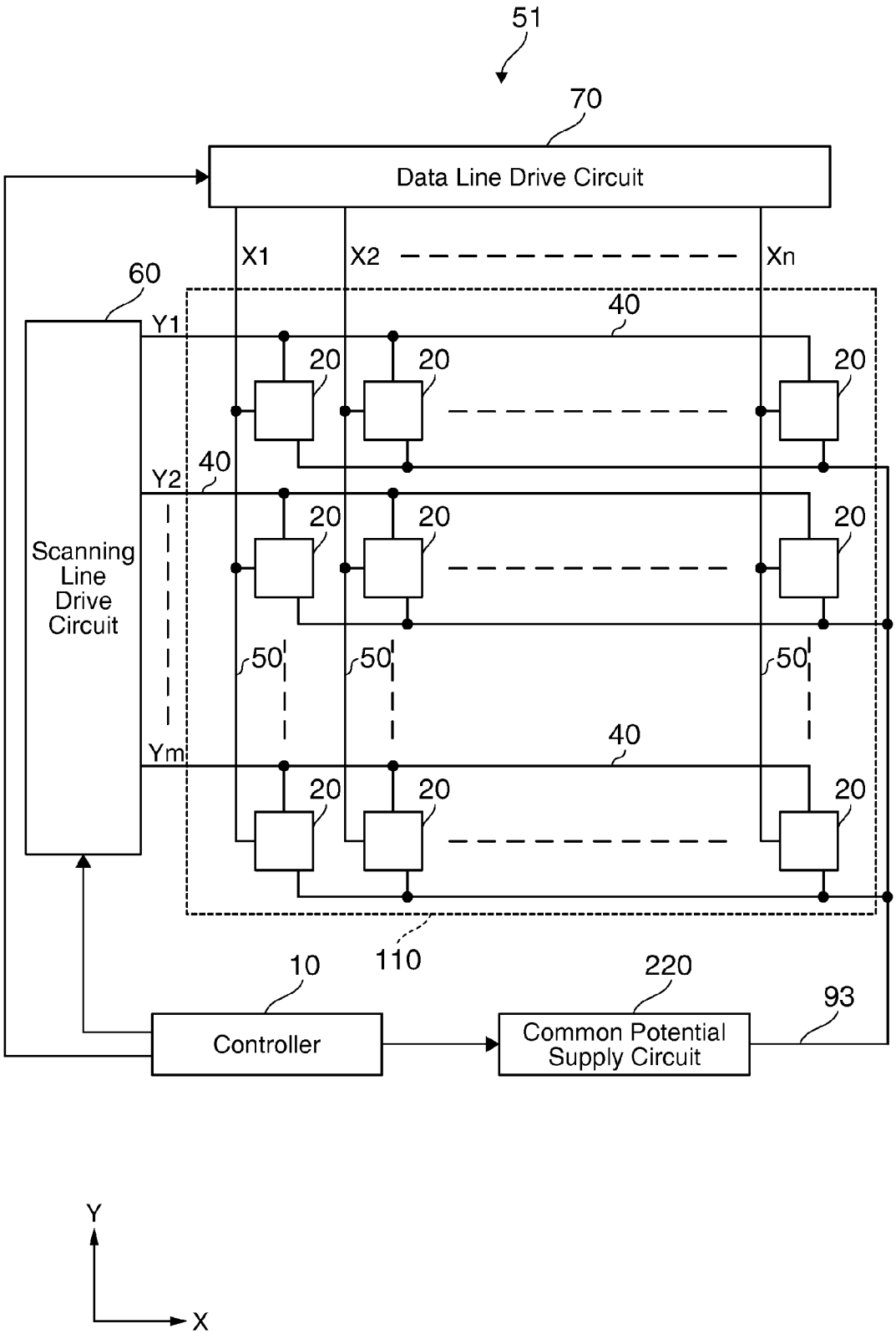
FIG. 2 is a block diagram of the configuration of a display section in accordance with the present embodiment.

FIG. 2 is a block diagram of the configuration of the display section in accordance with the present embodiment.

In FIG. 2, the front cover portion 51 in accordance with the present embodiment is an electrophoretic display device of an active matrix drive type, and is equipped with the left screen 110, a controller 10, a scanning line drive circuit 60, a data line drive circuit 70, and a common potential supply circuit 220.

On the left screen 110, m rows×n columns of pixels 20 are arranged in a matrix (in a two-dimensional plane). Also, on the left screen 110, m scanning lines 40 (that is, scanning lines Y1, Y2, . . . and Ym), and n data lines 50 (that is, data lines X1, X2, . . . and Xn) are arranged in a manner to intersect one another. Concretely, the m scanning lines 40 extend in a row direction (i.e., X direction), and the n data lines 50 extend in a column direction (i.e., Y direction). Pixels 20 are disposed at positions corresponding to intersections between the m scanning lines 40 and the n data lines 50.

The controller 10 controls the operation of the scanning lines drive circuit 60, the data line drive circuit 70, and the common potential supply circuit 220. The controller 10 supplies timing signals, such as, for example, a clock signal, a start pulse, etc., to each of the circuits.

The scanning line drive circuit 60 sequentially supplies a scanning signal in pulses to each of the scanning lines Y1, Y2, . . . , Ym during a predetermined frame period under the control of the controller 10.

The data line drive circuit 70 supplies data potentials to the data lines X1, X2, . . . , and Xn under the control of the controller 10. The data potential assumes a standard potential GND (for example, 0 volt), a high potential VH (for example, +15 volt) or a low potential VL (for example, −15 volt).

The common potential supply circuit 220 supplies a common potential Vcom (in the embodiment, the same potential as the reference potential GND) to the common potential line 93. Note that the common potential Vcom may be a potential different from the reference potential GND within the range where a voltage is not substantially generated between the counter electrode 22 to which the common potential Vcom is supplied and the pixel electrode 21 to which the reference potential GND is supplied.

Though various signals are input to and output from the controller 10, the scanning line drive circuit 60, the data line drive circuit 70, and the common potential supply circuit 220, the explanation for signals irrelevant to the present embodiment is omitted.

Figure 3:
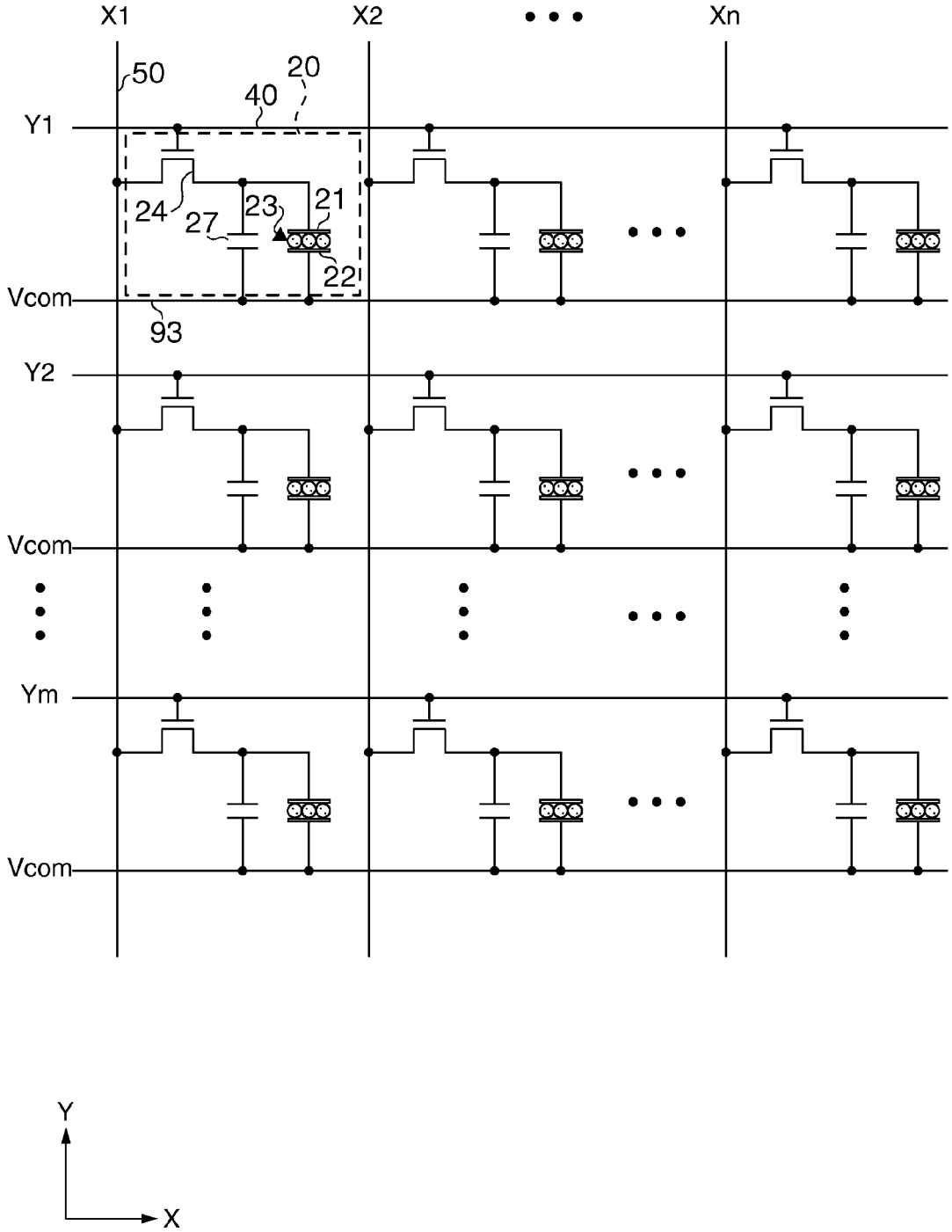
FIG. 3 is an equivalent circuit of the electrical configuration of a pixel in accordance with the present embodiment.

FIG. 3 is an equivalent circuit diagram of the electrical configuration of a pixel in accordance with the present embodiment.

As shown in FIG. 3, the pixel 20 is equipped with a pixel switching transistor 24, a pixel electrode 21, a counter electrode 22, an electrophoretic element 23, and a retention capacitance 27.

The pixel switching transistor 24 is formed from, for example, an N type transistor. The pixel switching transistor 24 has a gate electrically connected with the scanning line 40, a source electrically connected with the data line 50, and a drain electrically connected with the pixel electrode 21 and the retention capacitance 27. The pixel switching transistor 24 outputs data potential supplied from the data line drive circuit 70 (see FIG. 2) through the data line 50 to the pixel electrode 21 and the retention capacitor 27 with a timing corresponding to the scanning signal in pulses supplied through the scanning line 40 from the scanning line drive circuit 60 (see FIG. 2).

The data potential is supplied to the pixel electrode 21 from the data line drive circuit 70 through the data line 50 and the pixel switching transistor 24. The pixel electrode 21 and the electrophoretic element 23 are arranged in a manner mutually opposite to each other through the counter electrode 22.

The counter electrode 22 is electrically connected to the common potential line 93 to which the common potential Vcom is supplied.

The electrophoretic element 23 is formed from a plurality of microcapsules each containing electrophoretic particles.

The retention capacitance 27 is formed from a pair of electrodes arranged opposite each other through a dielectric film. One of the electrodes is electrically connected with the pixel electrode 21 and the pixel switching transistor 24, and the other electrode is electrically connected with the common potential line 93. The data potential can be retained only for a certain period by the retention capacitance 27.

Figure 4:
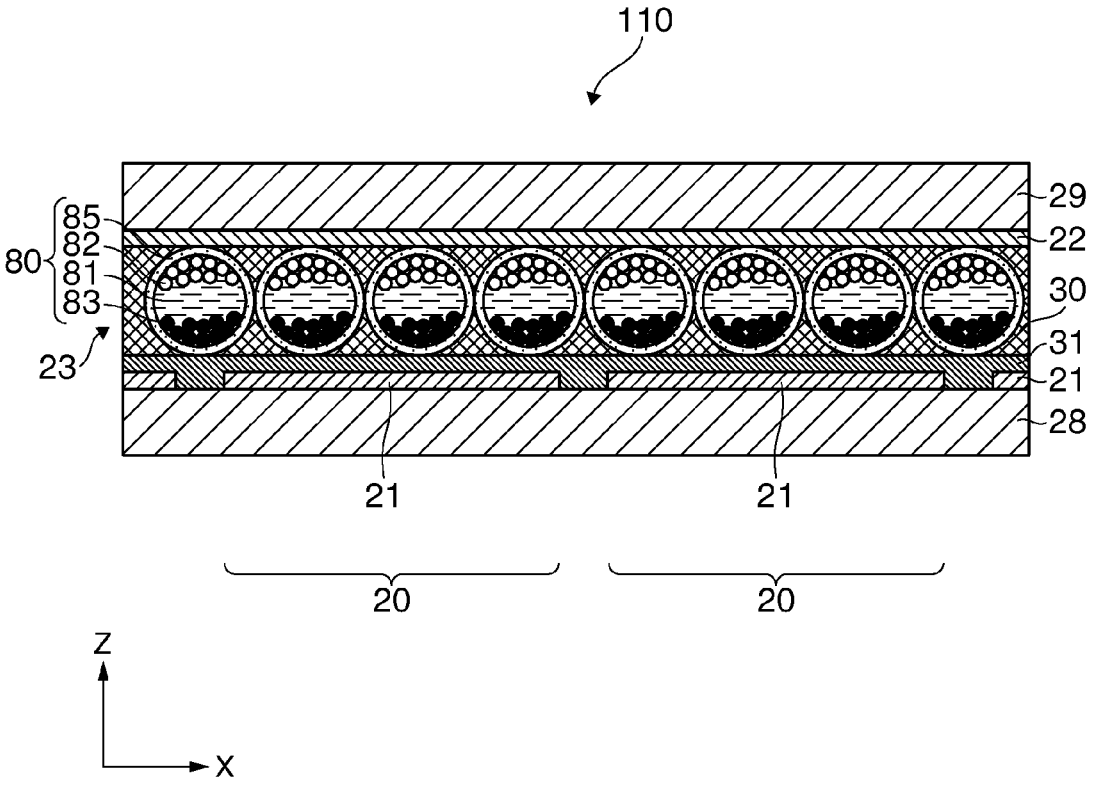
FIG. 4 is a cross-sectional view in part of the display section in accordance with the present embodiment.

FIG. 4 is a cross-sectional view in part of the display section in accordance with the present embodiment.

In FIG. 4, the left screen 110 is configured such that the electrophoretic element 23 is held between the element substrate 28 and the counter substrate 29. The embodiment is described assuming that an image is displayed on the side of the counter substrate 29.

The element substrate 28 is made of glass or plastic material, for example. A laminated structure in which the pixel switching transistor 24, the retention capacitance 27, the scanning lines 40, the data lines 50 and the common potential line 93 described above with reference to FIG. 3, though their illustration is omitted here, are formed on the element substrate 28. The plural pixel electrodes 21 are arranged on the upper layer side of the laminated structure in a matrix configuration.

The counter substrate 29 is a transparent substrate made of, for example, glass, plastics or the like. On an opposing surface of the counter substrate 29 facing the element substrate 28, a counter electrode 22 is formed solidly, opposite the plural pixel electrodes 21. The counter electrode 22 is made of a transparent conductive material, such as, for example, magnesium silver (MgAg), indium tin oxide (ITO), indium zinc oxide (IZO), or the like.

The electrophoretic element 23 is made up of a plurality of microcapsules 80 each containing electrophoretic particles. The electrophoretic element 23 is fixed between the element substrate 28 and the counter substrate 29 by means of a binder 30 made of a resin or the like and an adhesive layer 31. Note that the left screen 110 is structured, in the manufacturing process, with an electrophoretic sheet having the electrophoretic element 23 affixed in advance to the side of the counter substrate 29 with the binder 30 bonded to the element substrate 28 which is independently fabricated and has the pixel electrodes 21 and the like with the adhesive layer 31.

One or a plurality of microcapsules 80 are disposed in each of the pixels 20 (in other words, for each of the pixel electrodes 21) and sandwiched between the pixel electrode 21 and the counter electrode 22.

The microcapsule 80 includes a dispersion medium 81, a plurality of white particles 82 and a plurality of black particles 83 contained in a membrane 85. The microcapsule 80 is formed in a spherical body having a grain diameter of, for example, about 50 μm.

The membrane 85 functions as an outer shell of the microcapsule 80, and may be formed from acrylic resin such as polymethyl methacrylate and polyethyl methacrylate, or polymer resin having translucency such as urea resin, gum Arabic and gelatin.

The dispersion medium 81 is a solvent in which the white particles 82 and black particles 83 are dispersed in the microcapsule 80 (in other words, within the membrane 85). As the dispersion medium 81, water; alcohol solvents (such as, methanol, ethanol, isopropanol, butanol, octanol, and methyl cellosolve); esters (such as, ethyl acetate, and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, benzenes having a long-chain alkyl group (such as, xylene, hexylbenzene, butylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); carboxylates, and any one of other various oils may be used alone or in combination, and may be further mixed with a surfactant.

The white particles 82 are particles (polymer or colloid) made of white pigment, such as, for example, titanium dioxide, flowers of zinc (zinc oxide), antimony oxide, or the like, and may be negatively charged.

The black particles 83 are particles (polymer or colloid) made of black pigment, such as, for example, aniline black, carbon black or the like, and may be positively charged.

Accordingly, the white particles 82 and the black particles 83 can move in the dispersion medium 81 by an electric field generated by a potential difference between the pixel electrode 21 and the counter electrode 22.

A charge-controlling agent made of particles, such as, electrolytes, surfactant, metal soap, resin, rubber, oil, varnish or compound, a dispersing agent, such as, a titanium coupling agent, an aluminum coupling agent, a silane coupling agent, or the like, lubricant, stabilizing agent, and the like may be added to the aforementioned pigment as necessary.

As shown in FIG. 4, when a voltage is applied between the pixel electrode 21 and the counter electrode 22 to set the potential on the counter electrode 22 to be relatively higher than the other, the positively charged black particles 83 are drawn to the side of the pixel electrode 21 within the microcapsules 80 by a Coulomb force, and the negatively charged white particles 82 are drawn to the side of the counter electrode 22 within the microcapsules 80 by a Coulomb force. As a result, the white particles 82 gather on the side of the display surface (in other words, on the side of the counter electrode 22) within the microcapsules 80, whereby the color of the white particles 82 (i.e., white) is displayed at the display surface of the left screen 110. On the other hand, when a voltage is applied between the pixel electrode 21 and the counter electrode 22 to set the potential on the pixel electrode 21 to be relatively higher than the other, the negatively charged white particles 82 are drawn to the side of the pixel electrode 21 within the microcapsules 80 by a Coulomb force, and the positively charged black particles 83 are drawn to the side of the counter electrode 22 within the microcapsules 80 by a Coulomb force. As a result, the black particles 83 gather on the side of the display surface within the microcapsules 80, whereby the color of the black particles (i.e., black) is displayed at the display surface of the left screen 110.

Note that the pigment used for the white particles 82 or the black particles 83 may be replaced with other pigment of different color, such as, red, green, blue or the like, whereby red color, green color, blue color or the like can be displayed.

Figure 5:
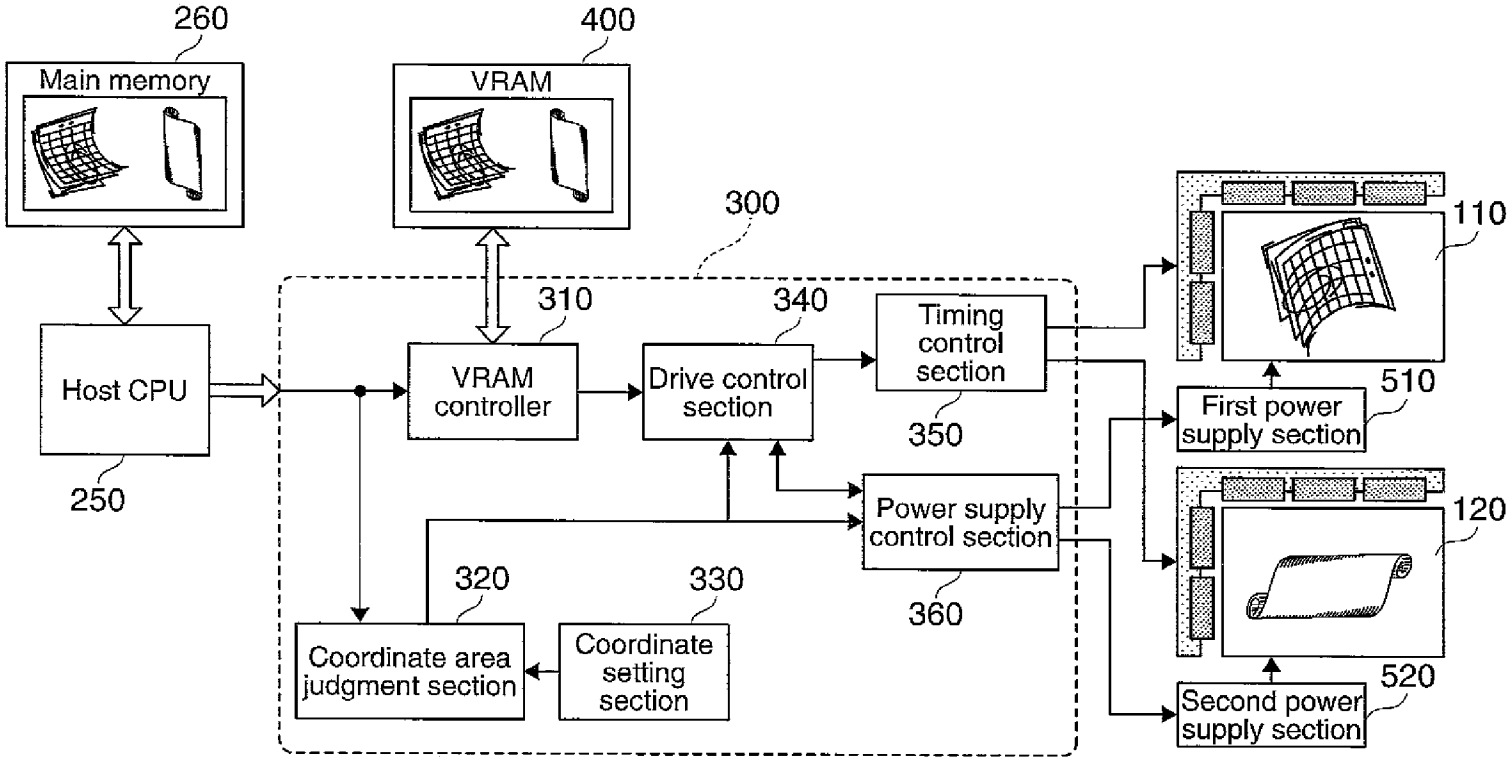
FIG. 5 is a block diagram of the configuration of a control section in accordance with the present embodiment.

Next, referring to FIG. 5, the configuration of the control section that controls the operation of the right screen 120 and the left screen 110 described above.

FIG. 5 is a block diagram of the configuration of the control section in accordance with an embodiment of the invention.

The control section 300 is an example of the "control device" of the embodiment of the invention, and includes a VRAM (Video Random Access Memory) controller 310, a coordinate area judging section 320, a coordinate setting section 330, a drive control section 340, a timing control section 350, and a power supply control section 360. Note that the control section 300 can be composed as a part of the controller 10 (see FIG. 2), or as another independent circuit.

The VRAM controller 310 controls the operation of a VRAM 400, which is an example of the "storage device" of the embodiment. Concretely, the VRAM controller 310 has image data that is input from the main memory 260 through a host CPU (Central Processing Unit) 250 to the control section 300 stored in the VRAM 400. Moreover, the VRAM controller 310 reads the image data stored in the VRAM 400, and outputs the image data to the driving control section 340.

Note that, in the VRAM 400 in accordance with the embodiment, image data of images that are to be displayed on the left screen 110 and the right screen 120 as shown in the figure is stored as data of one image which is an example of "image data of combined images" in accordance with the embodiment of the invention.

The coordinate area judgment section 320 is an example of the "judging device" of the embodiment, and judges as to whether the image data input from the host CPU 250 accompanies rewriting of the image of the left screen 110 or the right screen 120. The coordinate area judgment section 320 judges as to which one of the images of the left screen 110 and the right screen 120 is to be rewritten by using the coordinate information set to the coordinate setting section 330. Concretely, when the coordinates that should display the image are coordinates extending across the left screen 110 and the right screen 120, the coordinate area judgment section 320 judges that the images on both of the left screen 110 and the right screen 120 should be rewritten. On the other hand, when the coordinates that should display the image are coordinates corresponding only to one of the left screen 110 and the right screen 120, the coordinate area judgment section 320 judges that only one of the images of the left screen 110 and the right screen 120 should be rewritten.

The drive control section 340 supplies the image data input from the VRAM controller 310 to the left screen 110 and the right screen 120, respectively. The image data output from the drive control section 340 is first supplied to the timing control section 350, and then supplied from the timing control section 350 to the left screen 110 and the right screen 120, respectively, according to an appropriate timing. Note that the drive control section 340 and the timing control section 350 here are one example of the "rewriting device" of the embodiment.

The power supply control section 360 is an example of the "power supply stopping device" of the embodiment, and controls the operation of a first power supply section 510 for the left screen 110 and a second power supply section 520 for the right screen 120, thereby controlling the supply of the power supply potential to the left screen 110 and the right screen 120. The method for controlling the supply of the power supply potential will be described in detail below.

Control Method

The method for controlling the display device in accordance with an embodiment of the invention will be described with reference to FIG. 6. In the following description, operations of the control section 300 peculiar to the embodiment will be described in detail, and operations in other general parts may be omitted if appropriate.

Figure 6:
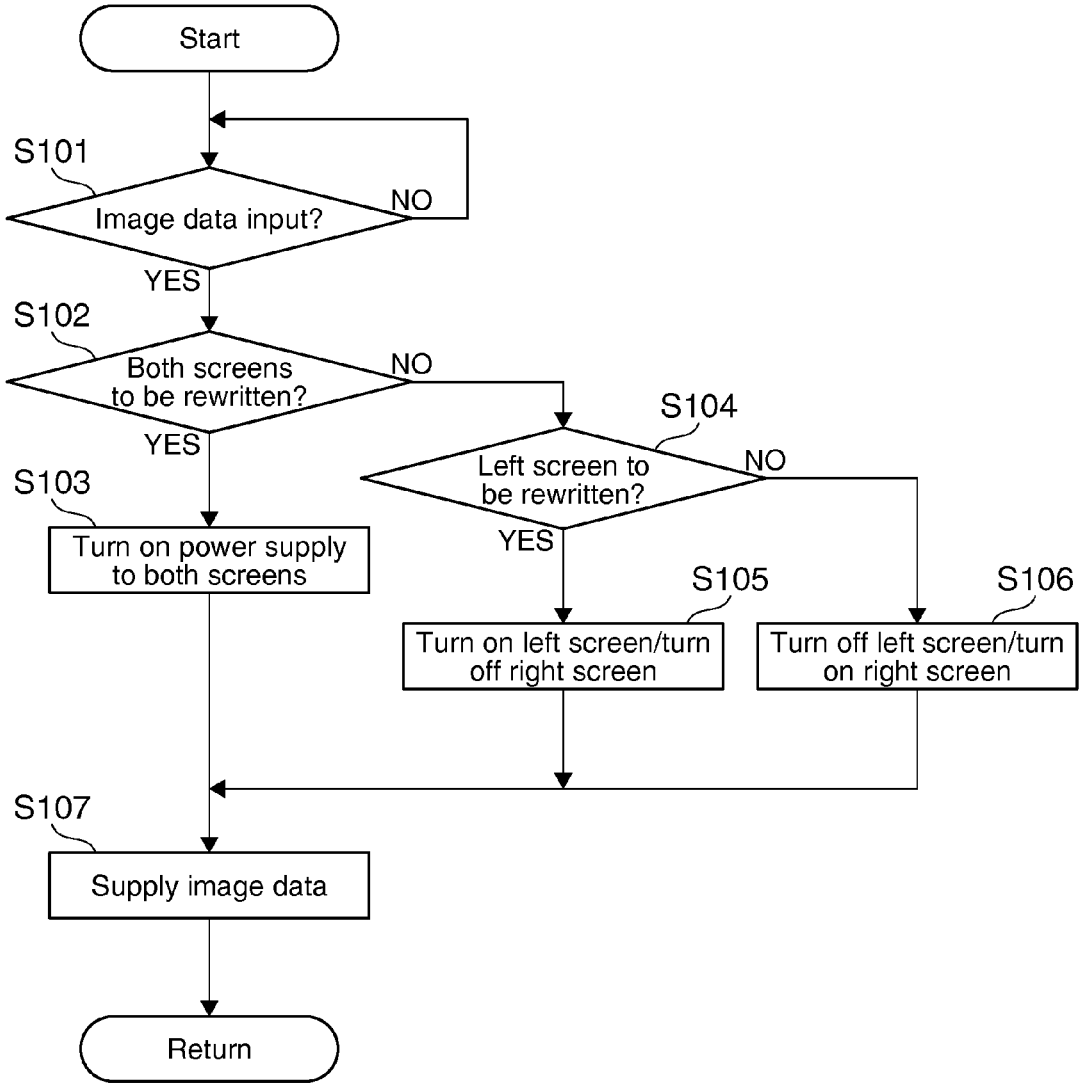
FIG. 6 is a flow chart of the operation of the display device in accordance with the present embodiment.

FIG. 6 is a flow chart showing the operation of the display device in accordance with the present embodiment.

In FIG. 6, during the operation of the display device 1 in accordance with the present embodiment, when image data is input to the control section 300 from the host CPU 250 (step S101: YES), the coordinate area judgment section 320 judges as to whether to rewrite both images on the left screen 110 and the right screen 120 (step S102). In other words, it judges as to whether the coordinates of the input image data cross over both of the left screen 100 and the right screen 120.

When it is judged that the images on both of the left screen 110 and the right screen 120 are to be rewritten (step S102: YES), the power supply control section 360 turns on both of the first power supply section 510 for the left screen 110 and the second power supply section 520 for the right screen 120 (step S103). As a result, display device 1 assumes a state in which the images on both the left screen 110 and the right screen 120 can be rewritten.

On the other hand, when it is judged that the images on both of the left screen 110 and the right screen 120 are not rewritten (in other words, the image on only one of the left screen 110 and the right screen 120 is rewritten) (step S102: NO), the coordinate area judgment section 320 judges as to whether the display section that should be rewritten is the left screen 110 (step S104).

When it is judged that only the image on the left screen 110 is to be rewritten (step S104: YES), the power supply control part 360 turns on the first power supply section 510 of the left screen 110, and turns off the second power supply section 520 of the right screen 120 (step S105). As a result, the display device 1 assumes a state in which the image on the left screen 110 can be rewritten, and the supply of the power supply potential to the right screen 120 where the image is not rewritten is stopped.

On the other hand, when it is judged that only the image on the right screen 120 is to be rewritten (step S104: NO), the power supply control part 360 turns off the first power supply section 510 of the left screen 110, and turns on the second power supply section 520 of the right screen 120 (step S106). As a result, the display device 1 assumes a state in which the image on the right screen 120 can be rewritten, and the supply of the power supply potential to the left screen 110 where the image is not rewritten is stopped.

In step S103, step S105, and step S106 described above, after switching on/off of the first power supply section 510 and the second power supply section 520, the image data to rewrite the image is supplied from the drive control section 340 to the left screen 110 and the right screen 120, respectively, through the timing control section 350 (step S107). As a result, the image on the screen where the image should be rewritten, among the left screen 110 and the right screen 120, is rewritten, and a new image is displayed.

In the embodiment, when it is judged that one of the images on the left screen 110 and the right screen 120 is not rewritten, the supply of the power supply potential to the display screen where the image is judged not to be rewritten is stopped by the power supply control section 360. Because the power consumption on one of the left screen 110 and the right screen 120 where the image is not necessary to be rewritten can be eliminated, the overall power consumption can be effectively reduced.

Moreover, in accordance with the embodiment, image data of images that are to be displayed on the left screen 110 and the right screen 120 is managed as image data of one image in the VRAM 400, such that the processing, from the viewpoint of the software that operates the device, can be made relatively simple, compared with the case where image data of an image to be displayed on the left screen 110 and image data of an image to be displayed on the right screen 120 are managed independently from each other.

As described above, by the display device 1 in accordance with the present embodiment, the power consumption can be suitably reduced.

Though an electrophoretic display device is exemplified as one example of the display device 1 in the embodiment, the display device 1 may be configured as a device having the memory property, such as, for example, a cholesteric liquid crystal display device, an electronic powder type display device or the like, or a display device of other types, such as, a liquid crystal display device, an organic EL display device or the like.

Moreover, in the embodiment, the display device with two screens is described. However, a display device with three or more screens can also achieve the effect described above by similar control. That is, by stopping the supply of a power supply potential to a display screen where an image is judged not to be rewritten, the power consumption can be reduced.

The invention is not limited to the embodiment described above, and may be suitably modified within the range that does not depart from the subject matter and the idea of the invention readable from the scope of patent claims and the entire specification, and display devices and methods for controlling a display device which include such modifications are deemed to be included in the technical scope of the invention.

The entire disclosure of Japanese Patent Application No. 2011-256269, filed Nov. 24, 2011 is expressly incorporated by reference herein.

What is claimed is:

1. A display device comprising:

a first display section and a second display section for displaying images;

a control device that controls operation of the first display section and the second display section; and a memory device that stores image data of an image to be displayed on the first display section and image data of an image to be displayed on the second display section as image data of one combined image, the control device including:

a rewriting device that rewrites the images on the first display section and the second display section by dividing and supplying the image data of one combined image respectively to the first display section and the second display section;

a judging device that judges as to which one of the images on the first display section and the second display section requires an image updating process wherein one of the images currently being displayed on the first display section or second display section needs to be rewritten; and a power supply stopping device that stops supply of a power supply potential, upon judging that one of the images on the first display section and the second display section is not to be rewritten, to the one of the first display section and the second display section, wherein the judging device has coordinate information corresponding to the first display section and the second display section, and judges as to which one of the images on the first display section and the second display section is to be rewritten based on coordinates where the combined image should be displayed.

2. A display device according to claim 1, wherein the first display section and the second display section have memory property.

3. A method for controlling a display device, the display device having a first display section and a second display section for displaying images; a control device that controls operation of the first display section and the second display section; and a memory device that stores image data of an image to be displayed on the first display section and image data of an image to be displayed on the second display section as image data of one combined image, the method comprising:

rewriting the images on the first display section and the second display section by dividing and supplying the image data of one combined image respectively to the first display section and the second display section;

judging as to which one of the images on the first display section and the second display section requires an image updating process wherein one of the images currently being displayed on the first display section or second display section needs to be rewritten; and upon judging that one of the images on the first display section and the second display section is not rewritten, stopping supply of a power supply potential to the one of the first display section and the second display section, wherein the judging device has coordinate information corresponding to the first display section and the second display section, and judges as to which one of the images on the first display section and the second display section is to be rewritten based on coordinates where the combined image should be displayed.

4. A display device comprising:

a first display section and a second display section for displaying images;

a control device that controls operation of the first display section and the second display section; and a memory device that stores image data of an image to be displayed on the first display section and image data of an image to be displayed on the second display section as image data of one combined image, the control device including:

a rewriting device that rewrites the images on the first display section and the second display section by dividing and supplying the image data of one combined image respectively to the first display section and the second display section;

a judging device that judges as to which one of the images on the first display section and the second display section requires an image updating process wherein one of the images currently being displayed on the first display section or second display section needs be to be rewritten based on the combined image; and a power supply stopping device that stops supply of a power supply potential, upon judging that one of the images on the first display section and the second display section is not to be rewritten, to the one of the first display section and the second display section, wherein the judging device has coordinate information corresponding to the first display section and the second display section, and judges as to which one of the images on the first display section and the second display section is to be rewritten based on coordinates where the combined image should be displayed.

* * * * *